US009280113B2

(12) United States Patent
Hirabayashi

(10) Patent No.: US 9,280,113 B2
(45) Date of Patent: Mar. 8, 2016

(54) IMAGE FORMING APPARATUS CAPABLE OF STABILIZING IMAGE DENSITY ON A SHORT-TERM AND LONG-TERM BASIS

(75) Inventor: Jun Hirabayashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/697,899

(22) PCT Filed: May 13, 2011

(86) PCT No.: PCT/JP2011/061591

§ 371 (c)(1),
(2), (4) Date: Nov. 14, 2012

(87) PCT Pub. No.: WO2011/145704

PCT Pub. Date: Nov. 24, 2011

(65) Prior Publication Data

US 2013/0071131 A1 Mar. 21, 2013

(30) Foreign Application Priority Data

May 18, 2010 (JP) ..... 2010-114472

(51) Int. Cl.
*G03G 15/00* (2006.01)

(52) U.S. Cl.
CPC .. *G03G 15/5041* (2013.01); *G03G 2215/00042* (2013.01)

(58) Field of Classification Search
CPC ..... G03G 15/0831; G03G 15/0843; G03G 15/0832; G03G 15/0848
USPC ..... 399/27, 47, 49, 51, 56, 58–62, 197, 399/198, 224, 258
See application file for complete search history.

(56) References Cited

U.S. PATENT DOCUMENTS 5,351,107 A * 9/1994 Nakane et al. ..... 399/49
6,898,391 B2 * 5/2005 Numagami et al. ..... 399/90

(Continued)

FOREIGN PATENT DOCUMENTS

EP 2 330 465 A1 9/2009
JP 2001-042613 A 2/2001

(Continued)

OTHER PUBLICATIONS

International Search Report issued in PCT/JP2011/061591 dated Jun. 28, 2011.
ISR issued Jun. 28, 2011 for PCT/JP2011/061592.

*Primary Examiner* — Clayton E LaBalle
*Assistant Examiner* — Ruifeng Pu
(74) *Attorney, Agent, or Firm* — Rossi, Kimms & McDowell LLP

(57) ABSTRACT

An image forming apparatus capable of stabilizing image density on a long-term basis by compensating for an error in prediction of toner particle charge amount, while reducing variation in image density on a short-term basis by the prediction. A CPU predicts an amount of electrostatic charge of toner particles in a developer container and sets an exposure condition and causes a toner image to be fixed on a recording medium and a pattern image for detecting image density, to be each formed on a photosensitive drum according to the set exposure condition, while performing gradation correction based on the gradation conversion table. The CPU updates the gradation conversion table such that a detected density of the pattern image becomes closer to a target density. The CPU sets the exposure condition based on a result of the prediction such that toner image density becomes constant.

6 Claims, 9 Drawing Sheets

(56) References Cited

U.S. PATENT DOCUMENTS

| | | | | |
|---|---|---|---|---|
| 7,050,729 | B2 * | 5/2006 | Fujiwara | 399/27 |
| 8,155,543 | B2 | 4/2012 | Ishibashi et al. | |
| 2002/0098005 | A1 | 7/2002 | Takeuchi et al. | |
| 2003/0026623 | A1 | 2/2003 | Hoshika | |
| 2011/0164888 | A1 * | 7/2011 | Kubo et al. | 399/27 |
| 2013/0064560 | A1 | 3/2013 | Hirabayashi | |

FOREIGN PATENT DOCUMENTS

| | | | |
|---|---|---|---|
| JP | 2001-136391 | A | 5/2001 |
| JP | 2010-102317 | A | 5/2010 |
| WO | 2010035432 | A1 | 4/2010 |

* cited by examiner

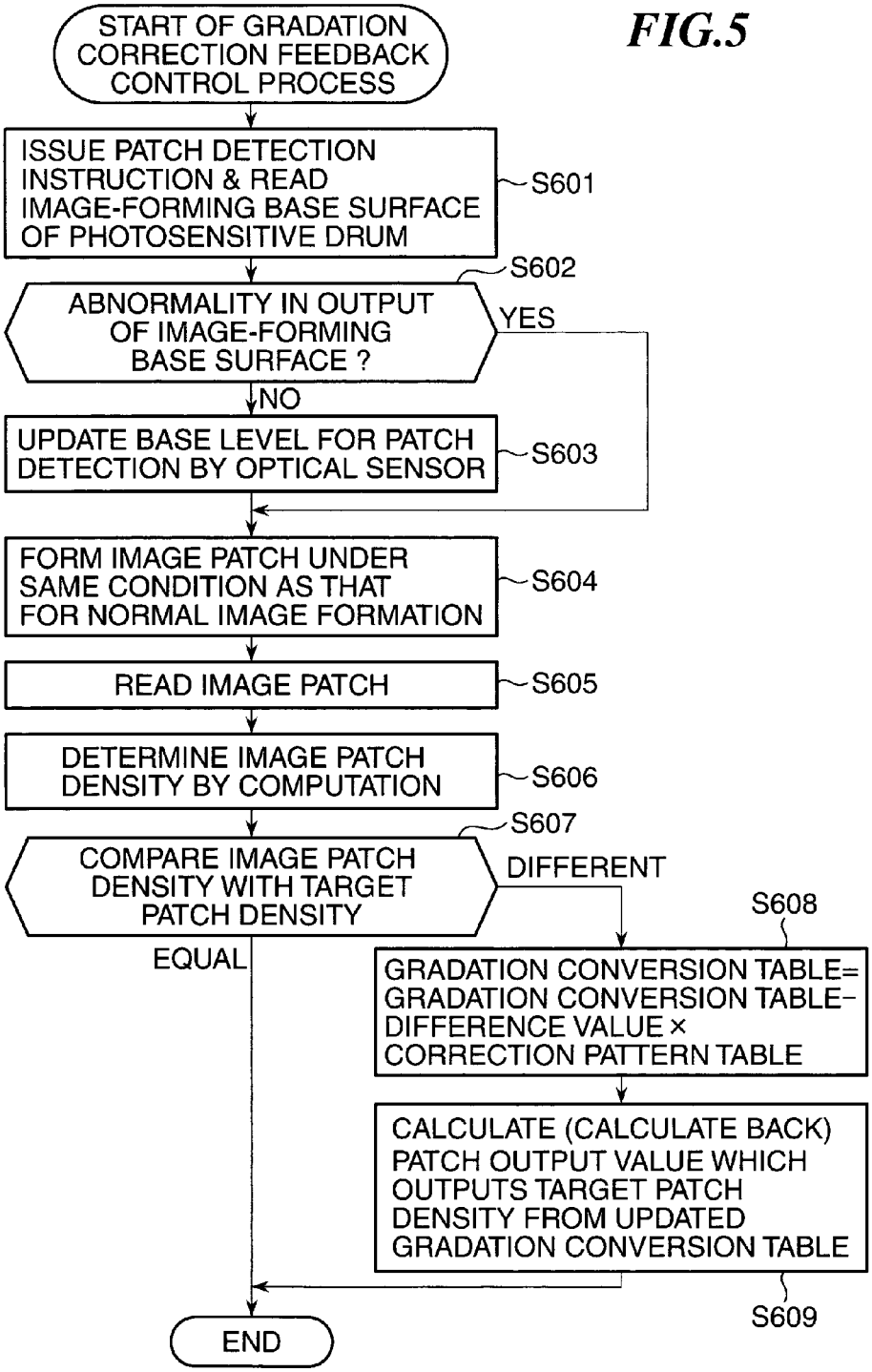
FIG.5
START OF GRADATION CORRECTION FEEDBACK CONTROL PROCESS
ISSUE PATCH DETECTION INSTRUCTION & READ IMAGE-FORMING BASE SURFACE OF PHOTOSENSITIVE DRUM
S601
S602
ABNORMALITY IN OUTPUT OF IMAGE-FORMING BASE SURFACE ?
YES
NO
UPDATE BASE LEVEL FOR PATCH DETECTION BY OPTICAL SENSOR
S603
FORM IMAGE PATCH UNDER SAME CONDITION AS THAT FOR NORMAL IMAGE FORMATION
S604
READ IMAGE PATCH
S605
DETERMINE IMAGE PATCH DENSITY BY COMPUTATION
S606
S607
COMPARE IMAGE PATCH DENSITY WITH TARGET PATCH DENSITY
DIFFERENT
EQUAL
S608
GRADATION CONVERSION TABLE= GRADATION CONVERSION TABLE− DIFFERENCE VALUE × CORRECTION PATTERN TABLE
CALCULATE (CALCULATE BACK) PATCH OUTPUT VALUE WHICH OUTPUTS TARGET PATCH DENSITY FROM UPDATED GRADATION CONVERSION TABLE
S609
END

IMAGE FORMING APPARATUS CAPABLE OF STABILIZING IMAGE DENSITY ON A SHORT-TERM AND LONG-TERM BASIS

TECHNICAL FIELD

The present invention relates to an image forming apparatus that performs image formation by electrophotography.

BACKGROUND ART

Conventionally, there has been known an image forming apparatus that performs image formation by electrophotography. This apparatus electrically charges toner particles and performs image formation using electrostatic force. Therefore, when the amount of electrostatic charge of toner particles changes, the density and quality level of an output image changes accordingly. The amount of electrostatic charge of toner particles largely varies with the usage environment, the density of an image to be output, output elapsed time, etc.

Particularly, in an electrophotographic image forming apparatus using a two-component development unit, i.e. in an image forming apparatus that uses toner particles and carrier particles as a developer, image formation is performed by filling up an electrostatic latent image formed by image exposure with electrostatically charged toner particles. In this apparatus, changes in image density due to changes in the amount of electrostatic charge of toner particles are frequently caused. The changes in image density affect not only the density of a solid image, but also all gradations. Therefore, gradation change is caused along with changes in the amount of electrostatic charge of toner.

To reduce variation in density of solid portions and halftone portions, i.e. variation in gradation, gradation correction feedback control is generally widely performed. In this control, an image patch (pattern image) at a desired gradation is output onto an image bearing member or a transfer member, and after measuring patch density (toner amount) on the image bearing member or the transfer member, gradation conversion is performed on the output image such that the output density becomes closer to a target density.

However, the gradation correction control based on the above-mentioned output density of the image patch is feedback control in which a gradation conversion table is created after measuring the density (toner amount) of the image patch, and then gradation conversion processing using the gradation conversion table is applied to an image to be output. Therefore, it is impossible to prevent dead time in control (time delay in control) from being generated. That is, this inevitably causes fluctuation in image density and gradation on a short-term basis.

To solve such a problem, there has been proposed a technique, e.g. in Patent Literature 1, for stabilizing image density by performing feedforward control in which an amount of electrostatic charge of toner particles is estimated (predicted), and a contrast potential in image formation is controlled on a real-time basis.

CITATION LIST

Patent Literature

PTL 1: Japanese Patent Laid-Open Publication No. 2001-42613

SUMMARY OF INVENTION

Technical Problem

However, even when the above-mentioned conventional feedforward control based on estimation of the amount of electrostatic charge of toner particles is performed, if a prediction error is too large, this causes a problem that stability in image density is rather lowered than when the feedforward control is not performed, which degrades image quality.

Therefore, from the point of view of stabilization of image density on a short-term basis and on a long-term basis, there is room for improvement.

The present invention has been made in view of these problems, and an object thereof is to provide an image forming apparatus which is capable of stabilizing image density on a long-term basis by compensating for an error in prediction of an amount of electrostatic charge of toner particles, while reducing variation in image density on a short-term basis by the prediction.

Solution to Problem

Accordingly, in a first aspect of the present invention, there is provided an image forming apparatus that performs image formation by electrophotography, comprising a predicting unit configured to predict an amount of electrostatic charge of toner particles in a developer container, a setting unit configured to set an exposure condition, a storage unit configured to store a gradation conversion table, an image creation unit configured to form a toner image to be fixed on a recording medium, on an image bearing member, according to the exposure condition set by the setting unit, while performing gradation correction based on a gradation conversion table stored in the storage unit, a forming unit configured to form a pattern image for detecting image density, on the image bearing member, according to the exposure condition set by the setting unit, while performing gradation correction based on the gradation conversion table stored in the storage unit, a detection unit configured to detect density of the pattern image formed by the forming unit, and an updating unit configured to update the gradation conversion table stored in the storage unit such that density of the pattern image, detected by the detection unit, becomes closer to a target density, wherein the setting unit sets the exposure condition based on a result of prediction by the predicting unit such that density of the toner image formed by the image creation unit becomes constant.

Accordingly, in a second aspect of the present invention, there is provided an image forming apparatus that performs image formation by electrophotography, comprising a predicting unit configured to predict an amount of electrostatic charge of toner particles in a developer container, a storage unit configured to store a gradation conversion table, an image creation unit configured to form a toner image to be fixed on a recording medium, on an image bearing member, while performing gradation correction based on a gradation conversion table stored in the storage unit, a forming unit configured to form a pattern image for detecting image density, on the image bearing member, while performing gradation correction based on the gradation conversion table stored in the storage unit, a detection unit configured to detect density of the pattern image formed by the forming unit, and an updating unit configured to update the gradation conversion table stored in the storage unit such that density of the pattern image, detected by the detection unit, becomes closer to a target density, wherein when forming the toner image, the image creation unit changes an output value of the gradation conversion table based on a result of prediction by the predicting unit such that variation in density of the toner image is reduced, and wherein when forming the pattern image, the forming unit changes an output value of the gradation conversion table based on a result of prediction by the predicting unit such that variation in density of the pattern image is reduced.

Advantageous Effects of Invention

According to the present invention, it is possible to stabilize image density on a long-term basis by compensating for an error in prediction of the amount of electrostatic charge of toner particles, while reducing variation in image density on a short-term basis by the prediction.

The features and advantages of the present invention will become more apparent from the following detailed description taken in conjunction with the accompanying drawings.

BRIEF DESCRIPTION OF DRAWINGS

FIG. 5 is a flowchart of a gradation correction feedback control process executed in a step in FIG. 2.

DESCRIPTION OF EMBODIMENTS

The present invention will now be described in detail below with reference to the drawings showing embodiments thereof.

Figure 1:
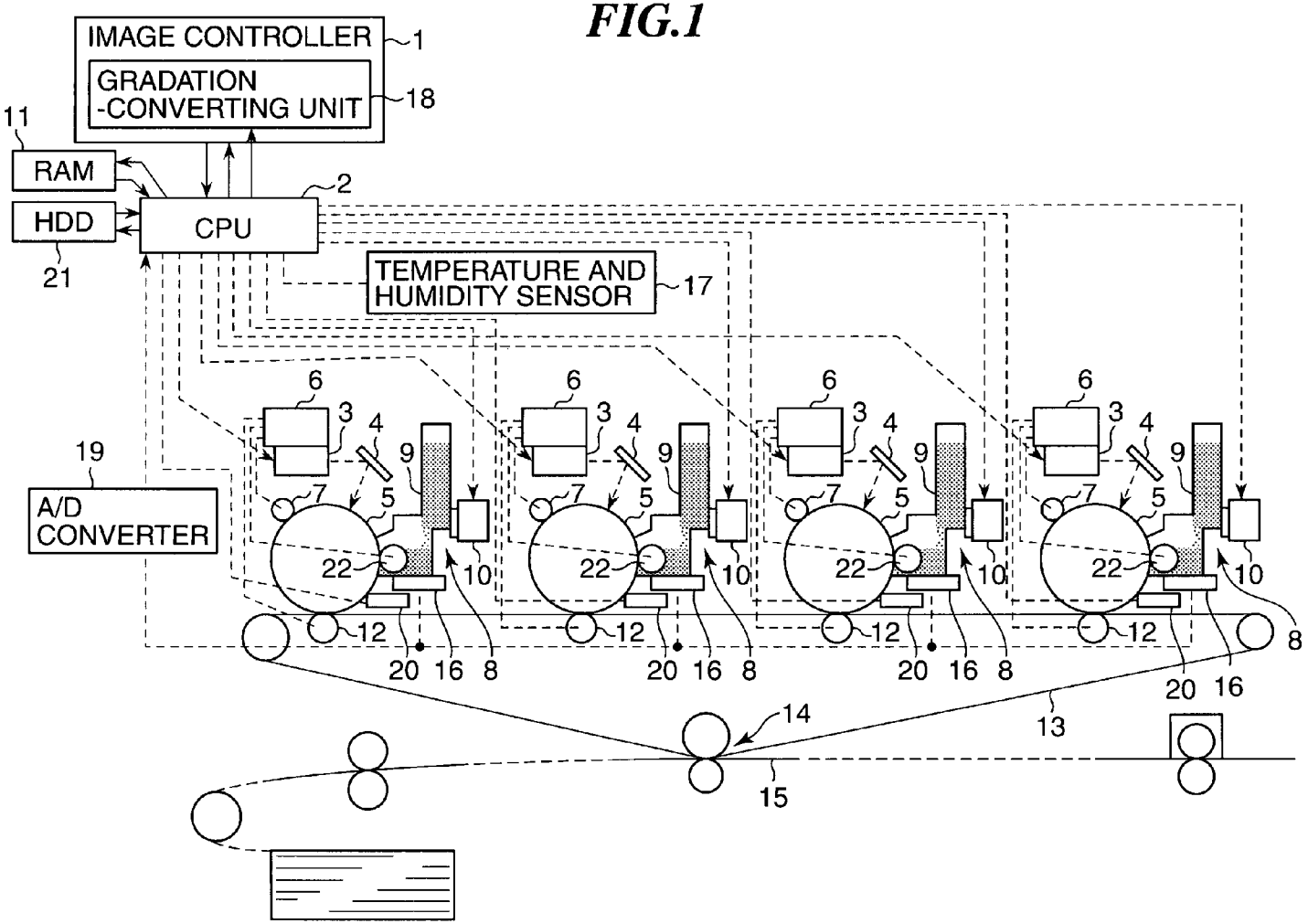
FIG. 1 illustrates an overall arrangement of an image forming apparatus according to a first embodiment of the present invention.

FIG. 1 illustrates an overall arrangement of an image forming apparatus according to a first embodiment of the present invention.

This image forming apparatus is a tandem-type image forming apparatus that performs image formation by electrophotography, and for example, is configured as a printer. The image forming apparatus includes four image forming sections, and each of them has the same configuration. Therefore, a description will be mainly given of one of them.

The image forming apparatus comprises a CPU (predicting unit, setting unit, forming unit, and updating unit) 2 that controls overall operations of the image forming apparatus, an image controller 1, a RAM (storage unit) 11, an HDD (hard disk drive) 21, and an A/D converter 19. Further, the main unit of the image forming apparatus includes a temperature and humidity sensor 17 and a timer, not shown. The image controller 1 includes a gradation-converting unit 18 provided therein.

Each image forming section includes a photosensitive drum (image bearing member) 5, a laser driver (hereinafter referred to as "the LD driver") 3, a reflective mirror 4, an electrostatic charger (charging roller) 7, a development device 8, a primary transfer device 12, and so on. The development device 8 is a two-component development unit including a developer container 9 for storing developer containing toner and carrier. The development device 8 includes not only a development roller 22 as a developer bearing member which carries developer thereon, but also a T/C ratio-detecting sensor 16, and an optical sensor (detection unit) 20. The CPU 2, and the charging roller 7, the LD driver 3, the development device 8, and so on controlled by the CPU 2 form "an image creation unit".

The image controller 1 receives an electric signal representative of image information described in a specific description language from a host computer or the like, not shown, (hereinafter referred to as "the PC"), and creates image data. Based on the created image data, the CPU 2 performs signal processing for creating a latent image by the LD driver 3, and delivers a signal therefor to the LD driver 3. In the LD driver 3, the delivered signal is converted to an optical signal, and the converted optical signal is irradiated to a polygon mirror attached to a polygon motor (not shown) which is rotated at a high speed. The irradiated optical signal is reflected by the polygon mirror, and is irradiated by the reflective mirror 4 onto a surface of the photosensitive drum 5 as a latent image bearing member.

The photosensitive drum 5 is uniformly electrically charged to a constant potential by the charging roller 7 controlled to a voltage value by a high-voltage output section 6 as a bias-applying unit which is a high-voltage power supply. The photosensitive drum 5 is irradiated with light (exposed to the light), whereby the potential at irradiated portions is changed, and as a result, an electrostatic latent image is formed on the photosensitive drum 5.

The present image forming apparatus has a mechanism that electrically charges the photosensitive drum 5 to a negative potential and toner particles to a negative potential, performs light irradiation on the photosensitive drum 5, and then causes toner particles to be attached to portions (bright portions) where the electrical potential is changed by the light irradiation. Further, the photosensitive drum 5 is in a state electrically charged to the constant potential using the charging roller 7 before the light irradiation, and hence, the electrical potential in the bright portions where toner is developed is varied with the light intensity of the light irradiated from the LD driver 3. That is, the amount of toner for development can be adjusted by controlling the amount of light irradiation to the photosensitive drum 5.

The development device 8 attaches only toner contained in the developer onto the photosensitive drum 5 by the development roller 22 to put (develop) the electrostatic latent image formed on the photosensitive drum 5 into a real and visual form as a toner image. The CPU 2 causes rotation of a toner replenishing motor 10 to thereby replenish toner into the developer container 9, as required. The CPU 2 holds a record of the toner replenishment amount within a predetermined time period in the RAM 11.

The development roller 22 has a developing bias controlled by the high voltage output section 6 applied thereto. The toner image formed by development on the photosensitive drum 5 is transferred onto an intermediate transfer belt 13 by the primary transfer device 12, and then is further transferred onto a surface of a recording medium 15, such as paper, by a secondary transfer device 14. The T/C ratio-detecting sensor 16 measures a mixture ratio between toner particles and carrier particles in the developer container 9. An output value from the T/C ratio-detecting sensor 16 is loaded into the CPU 2 via the A/D converter 19 at a required timing.

The recording medium 15 to which the toner image is transferred is conveyed by conveying rollers, and the transferred toner image is permanently fixed on the recording medium 15 by a fixing device. Then, the recording medium 15 is conveyed out of the image forming apparatus. A gradation conversion table is stored in the HDD 21, and is read out into the RAM 11 for reference.

Figure 2:
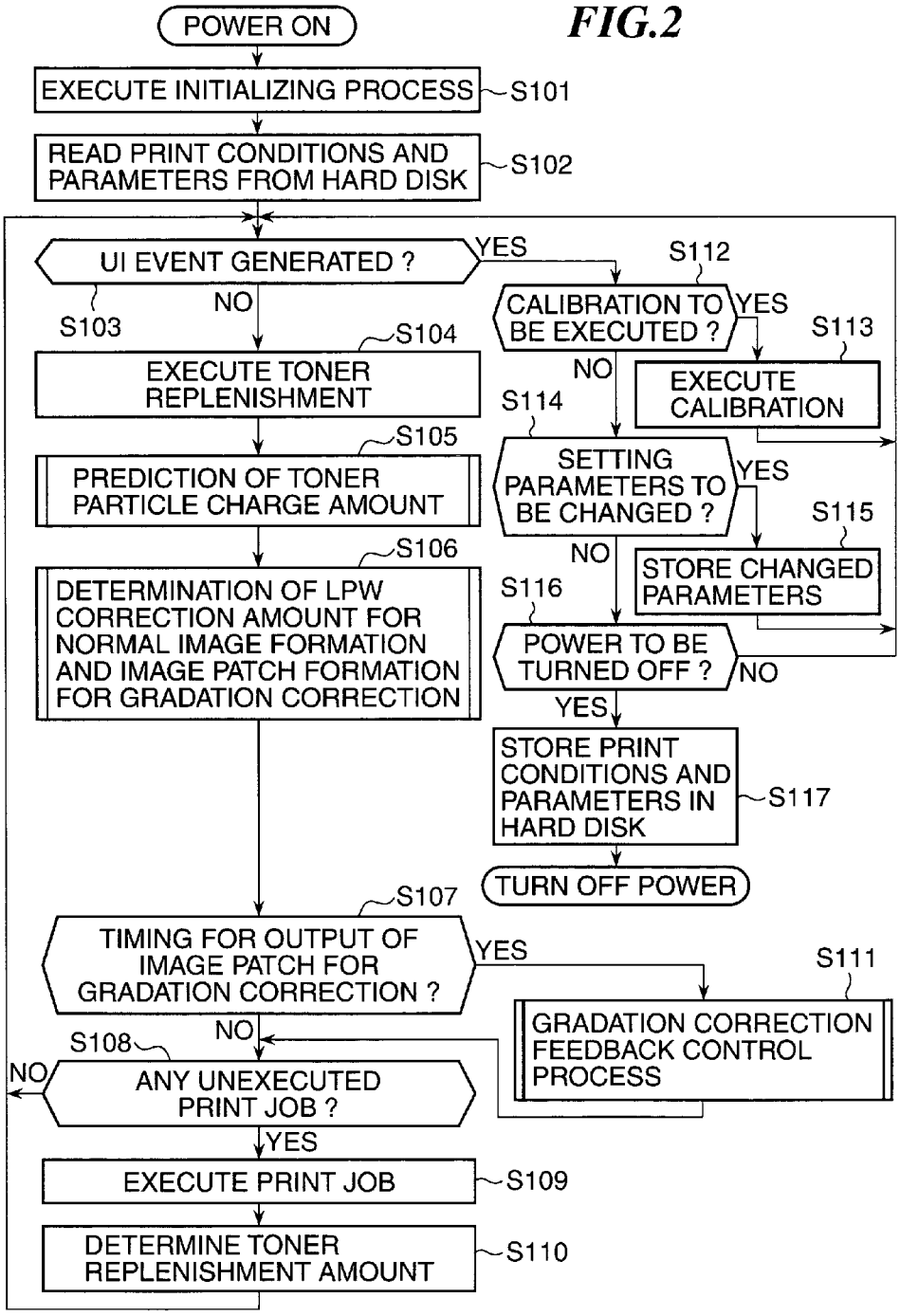
FIG. 2 is a flowchart of a basic operation control process in the present embodiment.

FIG. 2 is a flowchart of a basic operation control process in the present embodiment.

The outline of the basic operation control process will be explained. An amount of electrostatic charge of toner particles (toner charge amount) contained in the developer container 9 is predicted. Based on a result of the prediction, a potential forming condition is set such that the density of a toner image for a normal image to be formed by development on the photosensitive drum 5 becomes constant (steps S105 and S106, and FIGS. 3 and 4). Therefore, normally, i.e. unless it is determined in a step S107, referred to hereinafter, that it is timing for output of a patch for gradation correction, feed-forward control for reducing variation in the amount of electrostatic charge of toner particles is executed.

In the present embodiment, exposure intensity is set as an example of the potential forming condition. However, the potential forming condition is not limited to this, but it may be a setting of a charge bias or a setting of a developing bias, or may be a combination of these settings. Further, the object to be predicted is not limited to the toner charge amount, but it may be a more direct object, such as output image density or development toner density.

Further, a latent image of an image patch (pattern image) for detecting image density (for gradation correction) is formed on the photosensitive drum 5 under the exposure condition set as above. Then, an optical sensor 20 detects (measures) image density of the image patch formed by developing the latent image. Then, based on the patch density (toner amount) calculated from the detection result, the gradation conversion table is updated such that the output density of the image patch becomes closer to a target patch density (target density) (step S111 in FIG. 2, and FIGS. 5 and 6). Therefore, under a predetermined condition, i.e. if it is determined in the step S107, referred to hereinafter, that it is timing for output of a patch for gradation correction, gradation correction feedback control is executed.

Here, the potential forming condition is commonly used for toner image formation for a normal image and toner image formation for an image patch for gradation correction. The gradation conversion table is also commonly used for normal image formation and image patch formation.

The process in FIG. 2 is started when the power of the apparatus main unit is turned on. First, the CPU 2 executes an initializing process (step S101), and reads printing conditions and parameters from the HDD 21 into the RAM 11 (step S102). Next, in a step S103, the CPU 2 determines whether or not a user-interface (UI) event is generated. The user-interface event is generated by inputting of an instruction by a user from a console section, not shown.

Then, if a user-interface event is generated, the CPU 2 executes processing associated with the generated user-interface event. That is, the CPU 2 determines in a step S112 whether or not the user-interface event is an instruction for executing calibration. If it is determined that the user-interface event is an instruction for executing calibration (YES to the step S112), the CPU 2 executes calibration (step S113) and then returns the process to the step S103, whereas if not, the CPU 2 proceeds to a step S114, wherein it is determined whether or not the user-interface event is an instruction for changing a configuration parameter. If it is determined that the user-interface event is an instruction for changing a configuration parameter (YES to the step S114), the CPU 2 changes the configuration parameter and stores the changed parameter in the RAM 11 (step S115). Thereafter, the CPU 2 returns the process to the step S103. On the other hand, if it is determined that the user-interface event is not an instruction for changing a configuration parameter (NO to the step S114), the CPU 2 proceeds to a step S116, wherein it is determined whether or not the user-interface event is an instruction for turning the power off. If it is determined that the user-interface event is an instruction for turning the power off (YES to the step S116), the CPU 2 reads out the printing conditions and parameters from the RAM 111 and stores the same in the HDD 21 (S117), and then turns off the power of the apparatus, followed by terminating the present process. If it is determined that the user-interface event is not an instruction for turning the power off (NO to the step S116), the CPU 2 returns the process to the step S103.

If it is determined in the step S103 that no user-interface event is generated, the CPU 2 executes toner replenishment (step S104). In this step, an amount of toner is replenished which is determined by the immediately preceding execution of a step S110, referred to hereinafter. Next, the CPU 2 executes a process for predicting the amount of electrostatic charge of toner particles contained in the developer container 9 (step S105), and a process for determining an exposure intensity (hereinafter referred to as the "laser power" or "LPW") correction amount for normal image formation and image patch formation (step S106). These processes will be described hereinafter with reference to FIGS. 3 and 4. The laser power correction amount determined in the step S106 is commonly used in toner image formation for a normal image and toner image formation for an image patch.

Next, the CPU 2 determines whether or not it is timing of output of the image patch for gradation correction (step S107), and if it is determined that it is the timing, the CPU 2 executes the gradation correction feedback control (step S111), and then proceeds to a step S108. On the other hand, when it is not the timing (NO to the step S107), the CPU 2 directly proceeds to the step S108 without executing the gradation correction feedback control.

In the step S108, the CPU 2 determines whether or not there is a print job which has not been executed, and if there is no unexecuted print job (NO to the step S108), the CPU 2 returns the process to the step S103, whereas if there is an unexecuted print job (YES to the step S108), the CPU 2 executes the print job (step S109). During normal image formation by the print job, the laser power correction amount which is determined in the step S106 is reflected thereon. Therefore, the latent image formation is performed while performing exposure intensity correction using the laser power correction amount and gradation correction using the gradation conversion table (newest gradation conversion table) currently stored in the RAM 11. An image signal used for latent image formation is calculated by referring to the gradation conversion table.

Next, in the step S110, the CPU 2 determines the toner replenishment amount. The toner replenishment amount is determined based on the toner consumption amount. Thereafter, the CPU 2 returns the process to step S103.

Figure 3:
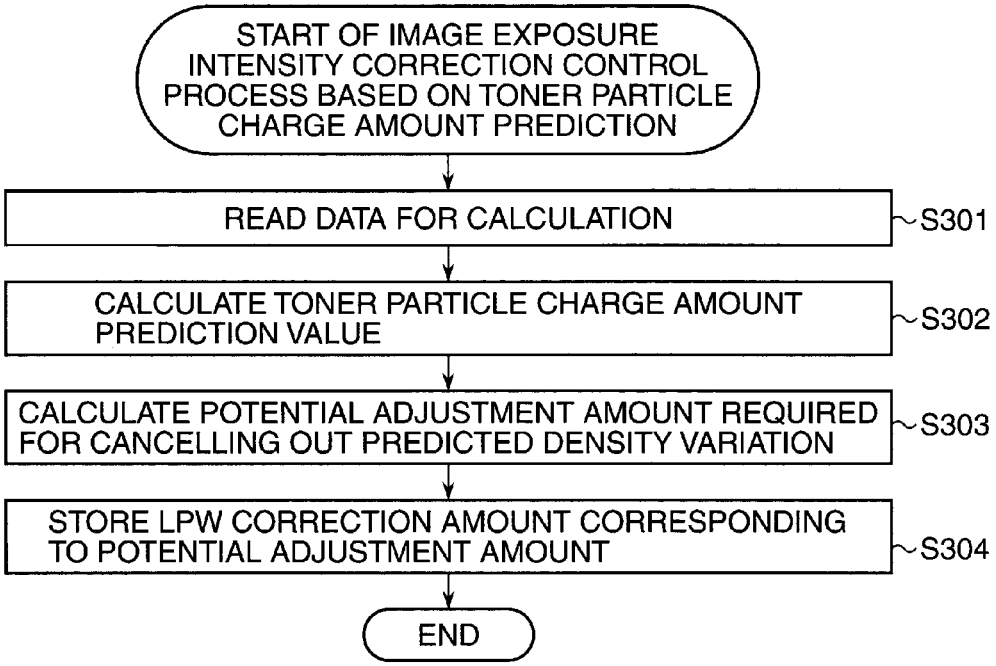
FIG. 3 is a flowchart of an image exposure intensity correction control process based on toner particle charge amount prediction.
Figure 4:
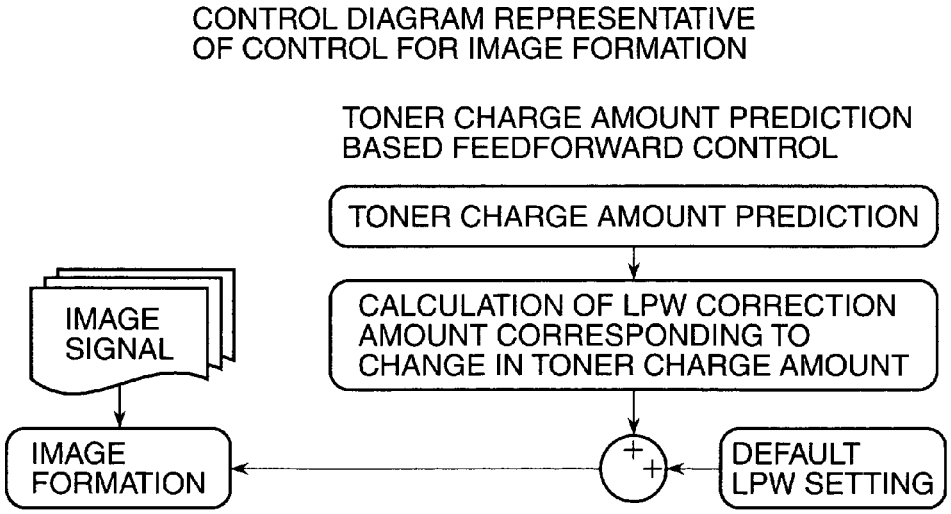
FIG. 4 is a control diagram in image formation.

FIG. 3 is a flowchart of an image exposure intensity correction (feedforward) control process based on toner particle charge amount prediction. The present process corresponds to the steps S105 and S106 in FIG. 2. FIG. 4 is a control diagram representative of control for image formation.

In the image exposure intensity correction control process, the toner charge amount is predicted at intervals of a predetermined time period (for each time step). To this end, the CPU 2 causes a toner consumption amount, a toner replenishment amount, and a toner amount in the developer container 9 in each time period to be stored in the RAM 11. For data items of the toner consumption amount and the toner replenishment amount which are stored, there are employed data of values averaged over time periods in respective time steps.

First, in a step S301 in FIG. 3, the CPU 2 reads data for calculating a prediction value of the amount of electrostatic charge of toner particles. This data includes data accumulated from the last calculation, the toner consumption amount, the toner replenishment amount, and so on. Next, the CPU 2 calculates a prediction value of the amount of electrostatic charge of toner particles (step S302). In this step, the prediction value of the amount of electrostatic charge of toner particles is calculated on a time step-by-time step basis, and an equation used for this calculation is switched depending on whether or not the development roller 22 is being rotated. When the development roller 22 is being rotated, the following equation (1) is used for the calculation, whereas when the development roller 22 is not being rotated, the following equation (2) is used for the calculation:

[Math. 1]

amount of electrostatic charge of toner particles (prediction value)=amount of electrostatic charge of toner particles in preceding time step×(1−calculation time step/α−development amount/toner amount in the developer container)+β×calculation time step/α+amount of electrostatic charge of toner particles in preceding calculation (1)

[Math. 2]

amount of electrostatic charge of toner particles (prediction value)=amount of electrostatic charge of toner particles in preceding time step×(1−γ) (2)

In the above equations, the three parameters of α, β, and γ are set in advance according to charging characteristics of toner. α represents a rate of frictional charging (elimination of electrostatic charge) per unit time, β represents a saturated amount of electrostatic charge of toner particles, and γ represents a rate of leakage of charges from toner particles per unit time. An initial value of the amount of electrostatic charge of toner particles is 0.

The "development amount/toner amount in the developer container" in a first term on the right side of the above equation (1) corresponds to "a charge balance between charged toner particles which are developed and uncharged toner particles which are supplied for replenishment". That is, the "development amount/toner amount in the developer container" corresponds to a reduced amount of electrostatic charge dependent on the consumption of toner in the developer container 9 and supply of toner thereto.

Part of the right side of the above equation (1) formed by the second term and the first term except the above-mentioned term therein corresponds to "an amount of change in the electrostatic charge of toner particles caused by frictional charging". The amounts explained above are added to the preceding amount of electrostatic charge of toner particles represented by the third term on the right side of the above equation (1), whereby the equation for predicting a next amount of electrostatic charge is formed. The above equation (2) shows that the toner particle charge amount decreases at a fixed time constant.

Further, in the present embodiment, a deviation or variation in the actual toner charge amount with respect to a predicted toner charge amount, i.e. a predetermined target toner charge amount, is estimated (predicted). To cancel out the variation in the density caused by the deviation/variation in the toner charge amount, the exposure intensity of light irradiated from the LD driver 3 for normal image output is feedforward controlled. More specifically, the CPU 2 adjusts the intensity of irradiation (image exposure intensity) of light from the LD driver 3 such that the potential contrast satisfies the following equation (3):

potential contrast at the time of image output=(potential contrast at a reference time/toner particle charge amount predicted at the reference time)× toner particle charge amount predicted at the time of image output [Math. 3]

In this equation, the "reference time" indicates a time at which a calibration operation is executed for color matching, or if it is configured not to execute the calibration operation, a time at which an output defining a color tone reference of an output image is executed, such as a start time of execution of an output job.

More specifically, in a step S303 in FIG. 3, the CPU 2 calculates a potential adjustment amount required to cancel out a predicted density variation. Next, in a step S304, the CPU 2 causes a laser power correction amount corresponding to the calculated potential adjustment amount to be stored in the RAM 11 as a laser power correction amount at the time of image output (potential forming condition).

The laser power (LPW) correction amount stored in this step is reflected on normal image formation of the print job in the step S109 in FIG. 2 and image patch formation in the step S111 in FIG. 2 (step S604 in FIG. 5). As shown in FIG. 4, the next normal image formation is performed at the exposure intensity obtained by adding the calculated and stored LPW correction amount to the exposure intensity of the default LPW setting.

By performing the above-mentioned adjustment of the latent image forming condition (potential contrast) used in image output such that variation in the density caused by the deviation/variation in the predicted toner charge amount is canceled out, it is possible to execute stable image density output in a manner unaffected by changes in the amount of electrostatic charge of toner particles.

However, if a deviation occurs between the predicted toner charge amount and the actual one, and accordingly, a deviation increases between the predicted amount of variation in the density and the actual one, the prediction-based control sometimes increases the deviation between the output density and the target image density. To solve such a problem, in the present embodiment, while the feedforward control for reducing variation in the amount of electrostatic charge of toner particles is performed, an image patch is formed under the same latent image forming condition (image exposure intensity) as that for normal image output. Further, based on the difference between the toner patch density (amount) and the target image density (toner amount), the gradation correction table applied in image output is updated.

Figure 6:
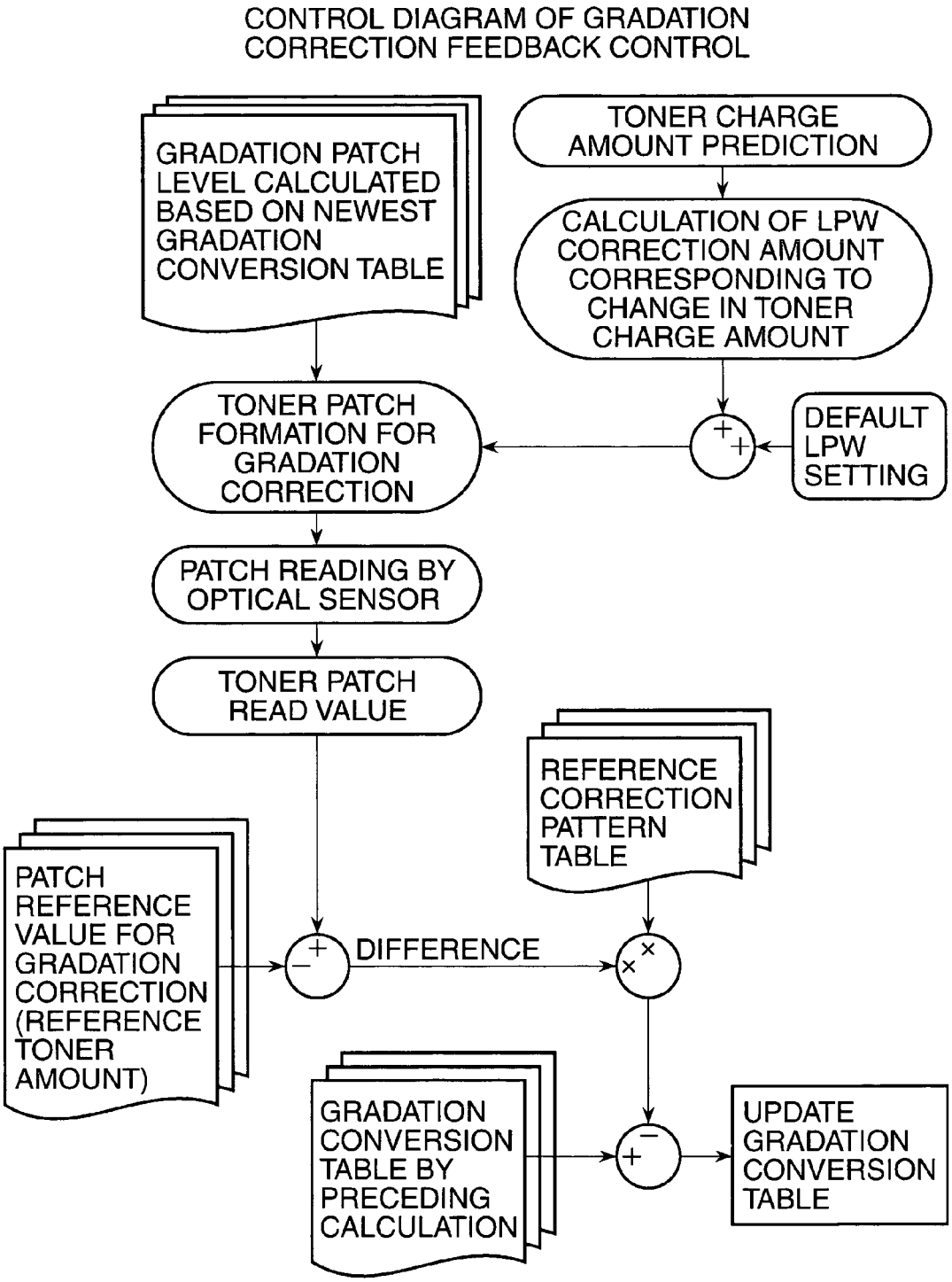
FIG. 6 is a control diagram of the gradation correction feedback control.

FIG. 5 is a flowchart of the gradation correction feedback control executed in the step S111 in FIG. 2. FIG. 6 is a control diagram of the gradation correction feedback control.

First, in FIG. 5, the CPU 2 issues a patch detection instruction for execution of image patch formation and density detection, and reads an image-forming base surface of the photosensitive drum 5 as an image bearing member (step S601). Next, the CPU 2 determines whether or not there is an abnormality in an output of the read image-forming base surface (step S602). As a result of the determination, if there is no abnormality (NO to the step S602), the process proceeds to a step S604, whereas if there is an abnormality (YES to the step S602), the CPU 2 updates a base level of the optical sensor 20 for detecting density of an image patch (step S603), and then proceeds to the step S604.

In the step S604, the CPU 2 forms an image patch for gradation correction under the condition equivalent to that in normal image formation. That is, the CPU 2 forms an image patch at a gradation patch level calculated based on the newest gradation conversion table currently stored in the RAM 11. In doing this, an image patch is formed at the exposure intensity obtained by correcting the default LPW setting by the laser power correction amount calculated and stored as above (step S304 in FIG. 3) (see FIG. 6). The gradation patch level used in this step was calculated (calculated backward) from the newest gradation conversion table, as a patch output value for outputting the target patch density, when the step S609 was executed last time.

Next, when the optical sensor 20 detects (measures) a density of the image patch (see FIG. 6), the CPU 2 receives the detection result (step S605), and determines the density of the image patch from the detection result by computation (step S606). It is assumed that as the density is higher, the patch density indicates a larger value.

Next, the CPU 2 compares the measured patch density determined by computation and a target patch density, and determines a difference value between the measured patch density and the target patch density (step S607). The difference value determined in this step is a value obtained by subtracting the target patch density (patch reference value for the gradation correction in FIG. 6) from the measured patch density (toner patch read value in FIG. 6).

Then, if there is no difference between the measured patch density and the target patch density, the CPU 2 terminates the present process, whereas if there is a difference between them, the CPU 2 executes steps 608 and 609, followed by terminating the present process.

In the step S608, the CPU 2 performs computation on the gradation conversion table currently stored in the RAM 11 by using an equation: "newest gradation conversion table=current gradation conversion table obtained by the preceding calculation−difference value×reference correction pattern table". By this computation, the gradation conversion table is updated (also see FIG. 6). That is, the newest gradation conversion table is caused to be stored in the RAM 11 in place of the current gradation conversion table. It should be noted that when the process in FIG. 5 is terminated, the newest gradation conversion table in the RAM 11 is stored in the HDD 21.

Next, in the step S609, the CPU 2 calculates (calculates backward) a patch output value (gradation patch level) for outputting the target patch density, from the updated newest gradation conversion table, followed by terminating the present process.

As described above, the gradation correction feedback control is executed in parallel with the feedforward control for reducing variation in the amount of electrostatic charge of toner particles based on toner particle charge amount prediction. The gradation conversion feedback control serves to compensate for a prediction error in the feedforward control. To this end, it is necessary to set the target patch density (target density) to a proper value. More specifically, the target patch density is set within a gradation (density) range in which changes in a development amount (density) are caused by the toner particle charge amount prediction-based (feedforward) control, i.e. within a gradation range in which an error which has occurred in the toner particle charge amount prediction-based control causes a density variation.

Figure 7:
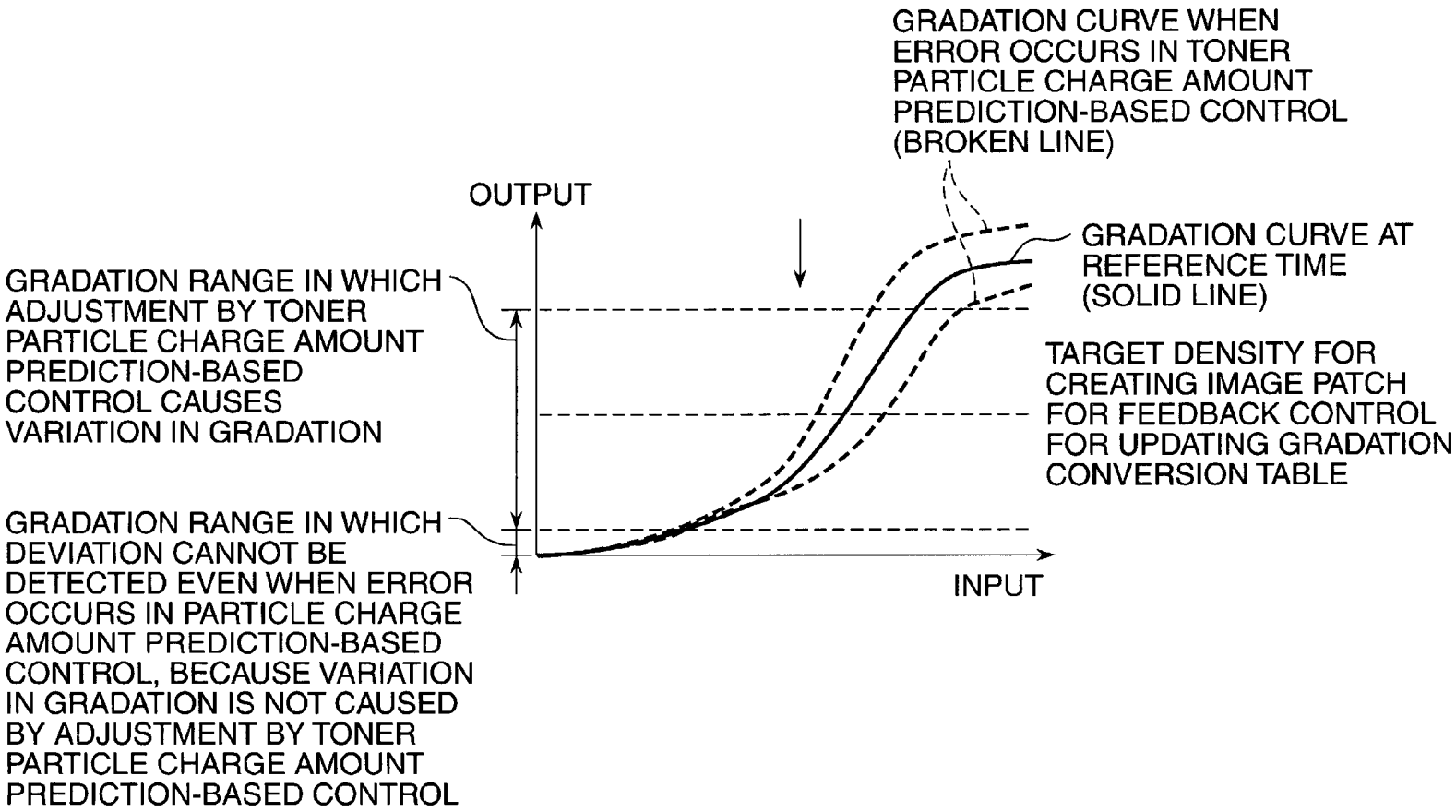
FIG. 7 illustrates a relationship between a target gradation (density) level used in the gradation correction feedback control process and a gradation range in which changes in the amount of development (density) are caused by a toner particle charge amount prediction-based (feedforward) control process.

FIG. 7 illustrates a relationship between the target gradation (density) level used in the gradation correction feedback control and the gradation range in which changes in the development amount (density) are caused by the toner particle charge amount prediction-based (feedforward) control.

As shown in FIG. 7, if an error occurs in the charge amount prediction, a deviation is generated in an output with respect to an input. However, due to characteristics of a pattern of a gradation curve, in a low gradation range which is not higher than a predetermined level (e.g. an image area ratio not more than 15%: extreme highlight range), the adjustment by the toner particle charge amount prediction-based control hardly causes changes in gradation. For this reason, even when an error occurs in the toner particle charge amount prediction-based control, the error cannot be detected. On the other hand, in a gradation range which is not lower than the predetermined level, the adjustment by the toner particle charge amount prediction-based control causes changes in gradation, and hence it is possible to recognize a change as a density deviation in the patch output. That is, the optical sensor 20 can detect a change in gradation of an image patch caused by a prediction error.

As described above, the target patch density is set in the gradation (density) range in which it is possible to detect changes in gradation of an image patch caused by a prediction error, an image patch is formed, and the gradation conversion table is updated. This makes it possible, even when a deviation is caused in the gradation curve (target gradation density curve) due to occurrence of an error in the toner particle charge amount prediction-based control, to correct (compensate for) the error such that the error is made closer to zero. Therefore, this prevents harmful effects caused by the error in the prediction control.

Conversely, in a case where the development device 8 has characteristics, as shown in FIG. 7, in which "changes in density (gradation) due to the toner particle charge amount prediction-based control" are generated, it is necessary not to use the extreme highlight range in which the development amount does not change even when an error occurs in the toner particle charge amount prediction-based control, as a gradation range at the time of output of an image patch for gradation correction. This is because if the image patch in the above-mentioned range is used, it is not possible to perform the gradation correction feedback control such that the error in the toner particle charge amount prediction-based control is cancelled out.

According to the present embodiment, by the image exposure intensity correction control (feedforward control), the amount of electrostatic charge of toner particles is predicted, and the potential forming condition is set on a real-time basis such that density of a normal image becomes constant, and hence it is possible to reduce variation in the image density on a short-term basis. Further, the gradation conversion table is updated to the newest one such that density of an image patch becomes closer to a target density, whereby the gradation correction feedback control is performed such that a prediction error in the feedforward control is cancelled out. As a result, even when an error occurs in the toner charge amount prediction, the gradation correction feedback control prevents generation of a density variation, which makes it possible to realize a stable image output which is always constant, whereby it is possible to compensate for a density deviation on a long-term basis caused by an error in prediction of the amount of electrostatic charge of toner particles. Particularly, the exposure condition and the gradation conversion table are commonly used for the feedforward control and the gradation correction feedback control. This makes it possible to compensate for a prediction error in the prediction of the amount of electrostatic charge of toner particles to thereby stabilize image density on a long-term basis, while reducing variation in density on a short-term basis by the prediction of the amount of electrostatic charge of toner particles.

Further, the target density is set within the gradation range in which it is possible to detect changes in gradation of an image patch caused by a prediction error in the feedforward control, and hence it is possible to properly perform the function of compensating for a prediction error.

Next, an image forming apparatus according to a second embodiment of the present invention will be described with reference to FIG. 8. The second embodiment differs from the first embodiment in the image exposure intensity correction control process based on toner particle charge amount prediction. Therefore, a description will be given of the second embodiment with reference to FIG. 8 in place of FIG. 3. The second embodiment differs from the first embodiment only in addition of control for changing the parameters $\alpha$ and $\beta$ based on the T/C ratio, and changing the parameters $\alpha$ and $\gamma$ based on the environmental humidity within the main unit of the image forming apparatus in the above equations (1) and (2). The other part of the configuration and manners of control aspects of the present embodiment are identical to those of the first embodiment, and hence a description thereof is omitted, but only different points are described, while denoting component elements corresponding to those of the first embodiment by identical reference numerals. The CPU 2 causes output values from the T/C ratio-detecting sensor 16 (values averaged over time period periods in respective time steps) and detection values from the temperature and humidity sensor 17 (particularly, values of environmental humidity) to be stored in the RAM 11.

Figure 8:
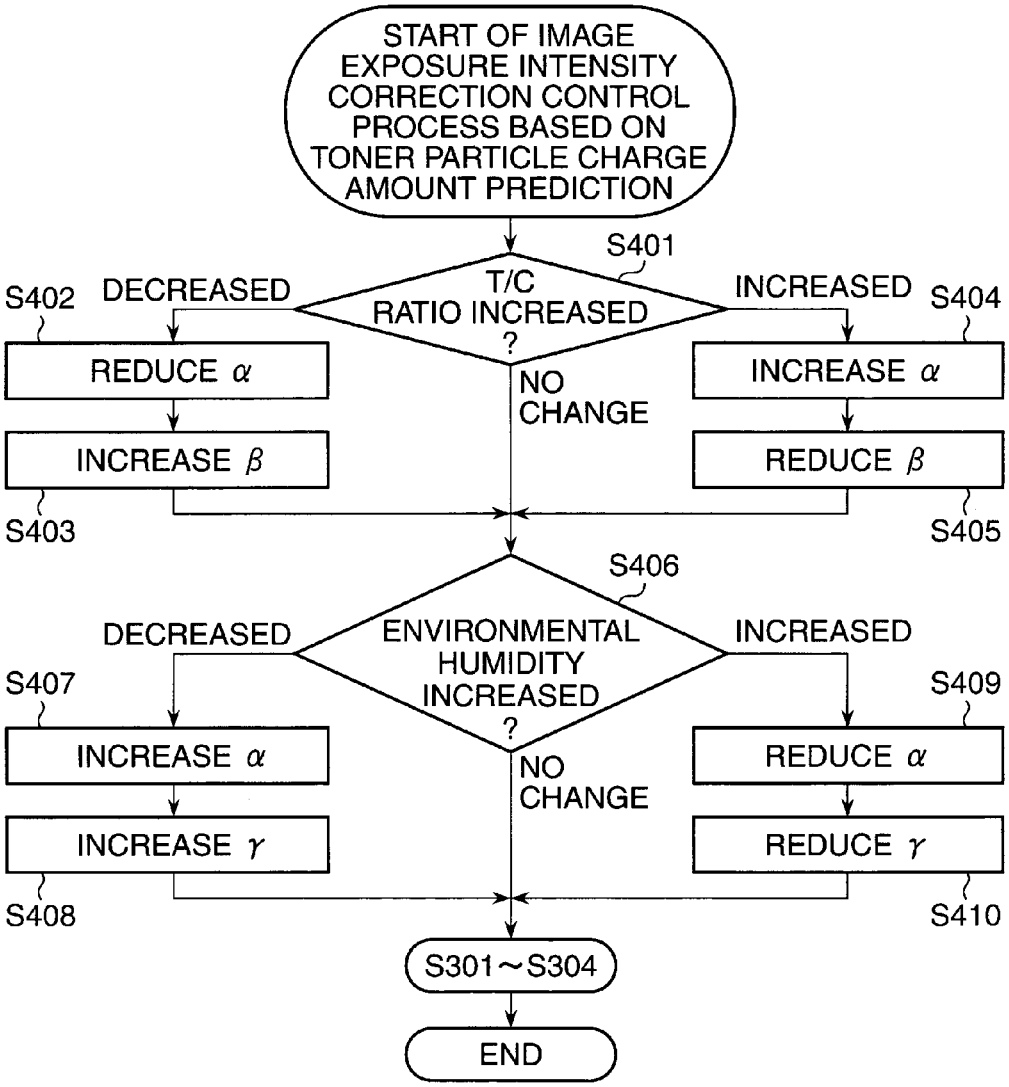
FIG. 8 is a flowchart of an image exposure intensity correction control process based on toner particle charge amount prediction, which is executed by an image forming apparatus according to a second embodiment of the present invention.

FIG. 8 is a flowchart of the image exposure intensity correction control process based on toner particle charge amount prediction, which is executed by the image forming apparatus according to the second embodiment.

The CPU 2 determines based on an output value from the T/C ratio-detecting sensor 16 whether or not the T/C ratio has increased (step S401). As a result of the determination, if the T/C ratio has decreased, the CPU 2 reduces the value of $\alpha$ in the above equation (1) (step S402), and increases the value of $\beta$ in the same (step S403). On the other hand, if the T/C ratio has increased, the CPU 2 increases the value of $\alpha$ in the above equation (1) (step S404), and reduces the value of $\beta$ (step S405) in the same. If there is no change in the T/C ratio, the CPU 2 changes neither the value of $\alpha$ nor that of $\beta$.

Next, the CPU 2 determines based on a detection value from the temperature and humidity sensor 17 whether or not the environmental humidity has become higher than before (step S406). As a result of the determination, if the environmental humidity has increased, the CPU 2 reduces the value of $\alpha$ in the above equation (1) (step S409), and reduces the value of $\gamma$ in the equation (2) (step S410). On the other hand, if the environmental humidity has decreased, the CPU 2 increases the value of $\alpha$ in the above equation (1) (step S407), and increases the value of $\gamma$ in the above equation (2) (step S408). If there is no change in the environmental humidity, the CPU 2 changes neither the value of $\alpha$ nor that of $\gamma$.

More specifically, when the T/C ratio has increased, the CPU 2 changes the parameters in a direction in which the calculated value (predicted value) of the toner particle charge amount is reduced. Further, when the environmental humidity has increased, the CPU 2 changes the parameters in a direction in which the calculated value of the rate of frictional charging (elimination of electrostatic charge) per unit time is reduced. Alternatively, when the environmental humidity has increased, the CPU 2 may change the parameters in a direction in which the toner particle charge amount (predicted value) is reduced.

Thereafter, the CPU 2 executes the same processing as executed in the steps S301 to S304 in FIG. 3, followed by terminating the present process.

Although the saturated toner particle charge amount, the rate of friction charging (elimination of electrostatic charge) per unit time, and the rate of charge leakage from toner particles per unit time vary with the T/C ratio and the environmental humidity, it is possible to properly adjust these parameters by executing the steps S401 to S410. By performing this adjustment, even when the environment in which the image forming apparatus is installed changes, causing changes in the change characteristics of the toner charge amount, it is possible to perform toner particle charge amount prediction with accuracy in a manner coping with changes in the change characteristics. This improves accuracy in the image exposure intensity correction control.

Therefore, according to the present embodiment, it is possible to obtain the same advantageous effects as provided by the first embodiment, and particularly, it is possible to improve the accuracy in the feedforward control based on the toner particle charge amount prediction, and thereby effectively reduce variation in the image density on a short-term basis.

It should be noted that for correction of the parameters, only one of the T/C ratio and the environmental humidity may be employed Next, an image forming apparatus according to a third embodiment of the present invention will be described with reference to FIGS. 9 to 10B. In the above-described first embodiment, the correction control based on toner particle charge amount prediction is applied to the laser power correction amount at the time of normal image output. However, the third embodiment differs from the first embodiment in that the correction control based on the toner particle charge amount prediction is applied to the gradation conversion table. The other part of the configuration and manners of control aspects of the present embodiment are identical to those of the first embodiment, and hence a description thereof is omitted, but only different points are described, while denoting component elements corresponding to those of the first embodiment by identical reference numerals. The gradation-converting unit 18 (see FIG. 1) is controlled to reduce a change in the predicted toner charge amount, i.e. a predicted change in density. Therefore, a description will be given of the third embodiment with reference to FIG. 9 in place of FIGS. 3 and 4, and further with reference to FIGS. 10A and 10B.

Figure 9:
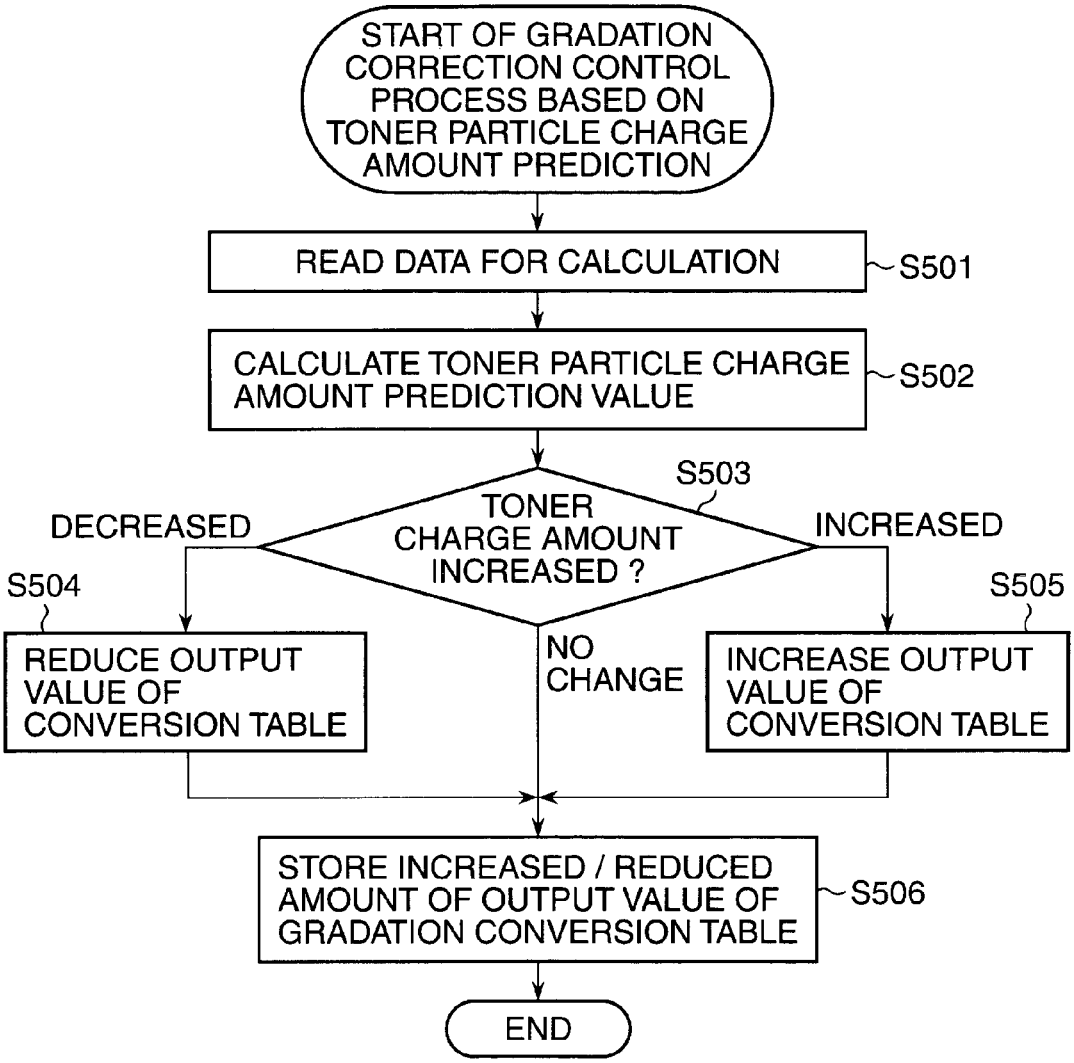
FIG. 9 is a flowchart of a gradation correction control process based on toner particle charge amount prediction, which is executed by an image forming apparatus according to a third embodiment of the present invention.

FIG. 9 is a flowchart of a gradation correction control process based on toner particle charge amount prediction, which is executed by the image forming apparatus according to the third embodiment. The gradation correction control process in FIG. 9 is executed in place of the steps S105 and 106 in FIG. 2 in a manner inserted between the steps S104 and S107 therein.

In steps S501 and S502 in FIG. 9, the CPU 2 executes the same processing as executed in the steps S301 and S302 in FIG. 3. Next, in a step S503, the CPU 2 determines from a result of the toner particle charge amount prediction whether or not the amount of electrostatic charge of toner particles has increased. Then, based on the result of the determination, the CPU 2 increases or reduces a value of an output with respect to an input in the gradation conversion table stored in the RAM 11 (steps S504 and S505). This processing for increasing or reducing the value of the output is executed by the gradation-converting unit 18 under the control of the CPU 2.

That is, if the amount of electrostatic charge of toner particles has decreased, the CPU 2 causes the value of the output to be reduced with respect to the input in the gradation conversion table (step S504). On the other hand, if the amount of electrostatic charge of toner particles has increased, the CPU 2 causes the value of the output to be increased with respect to the input in the gradation conversion table (step S505). Further, if there is no change in the amount of electrostatic charge of toner particles, the CPU 2 holds the value of the output with respect to the input in the gradation conversion table as it is.

Figure 10A:
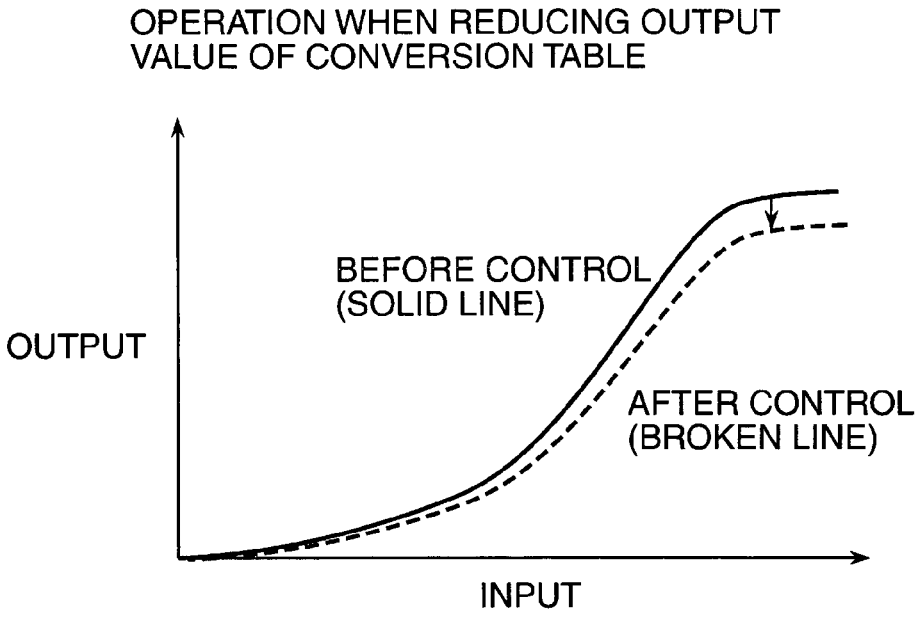
FIG. 10A illustrates an example of a case where an output value of a gradation conversion table is reduced by the gradation correction.
Figure 10B:
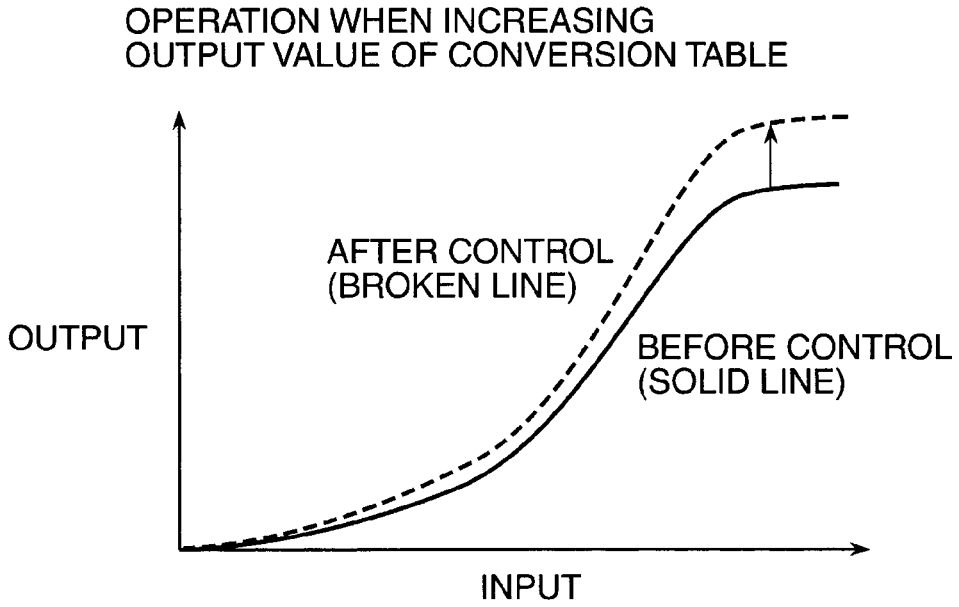
FIG. 10B illustrate illustrates an example of a case where the output value of the gradation conversion table is increased by the gradation correction.

FIGS. 10A and 10B illustrate respective examples of cases where the value of the output in the gradation conversion table is reduced and increased. In a step S506 in FIG. 9, the CPU 2 causes an increased or reduced amount of the value of the output with respect to the input in the gradation conversion table to be stored in the RAM 11. More specifically, the CPU 2 stores data of table representation curves (indicated by broken lines), as shown in FIGS. 10A and 10B, which have been obtained by subjecting an original table representation curve (indicated by a solid line) to respective increasing and decreasing control operations. Then, when a normal image is formed by the print job in the step S109 in FIG. 2, and when an image patch is formed in the step S604 in FIG. 5, the stored data of the table representation curves is reflected on the output of gradation conversion.

Here, a degree of increase or decrease of the output value is set by an amount dependent on the result of the toner particle charge amount prediction. However, this is not limitative, but any suitable amount can provide same advantageous effects, insofar as it increases or reduces the output value in a direction in which variation in the density of the toner image is reduced when forming a toner image for normal image formation.

It should be noted that an object to be predicted is not limited to the toner charge amount, but it may be a more direct object, such as development toner density (toner output density). In that case, when the development toner density is predicted to increase, the value of output in the gradation conversion table is reduced, whereas when the development toner density is predicted to decrease, the value of output in the gradation conversion table is increased.

According to the third embodiment, the processing for increasing or reducing the value of output in the gradation conversion table based on a result of the toner particle charge amount prediction makes it possible to obtain the same advantageous effects concerning the reduction of variation in image density on a short-term basis as provided by the first embodiment. Further, the gradation correction feedback control in which the gradation conversion table is updated such that the density of an image patch becomes closer to a target density makes it possible to compensate for a density deviation on a long-term basis which is caused by the error in the toner particle charge amount prediction. That is, even when an error occurs in the toner particle charge amount prediction-based control, the feedback control based on image patch output is executed using a density level at which the prediction has influence on the density, as a target gradation (density), whereby it is possible to perform error correction compensation. Therefore, it is possible to stabilize image density on a long-term basis by compensating for an error in toner particle charge amount prediction, while reducing variation in density on a short-term basis by the toner particle charge amount prediction.

It should be noted that in the third embodiment, the steps S401 to S410 in FIG. 8 (correction of the values of $\alpha$, $\beta$, and $\gamma$) in the second embodiment can be applied to the gradation correction control process based on toner particle charge amount prediction in FIG. 9.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

REFERENCE SIGNS LIST

1 image controller
2 CPU
5 photosensitive drum
9 developer container
11 RAM
16 T/C ratio-detecting sensor
20 optical sensor

The invention claimed is:

1. An image forming apparatus comprising:

a predicting unit configured to predict an amount of electrostatic charge of toner particles in a developer container;

a determining unit configured to determine an exposure condition based on the amount of electrostatic charge of the toner particles predicted by the predicting unit;

a storage unit configured to store a gradation conversion table;

a converting unit configured to convert image data based on the gradation conversion table stored in the storing unit;

an image forming unit configured to form an image based on the converted image data converted by the converting unit, the image forming unit having an image bearing member, an exposure unit configured to expose the image bearing member using light according to the exposure condition determined by the determining unit to form an electrostatic latent image on the image bearing member, and a development unit configured to develop the electrostatic latent image using toner particles;

a measuring unit configured to measure a pattern image formed by the image forming unit;

a controlling unit configured to control the converting unit to convert pattern image data based on the gradation conversion table, control the exposure unit to expose the image bearing member based on the converted pattern image data using light according to the exposure condition determined by the determining unit to form a pattern image, and control the measuring unit to measure the pattern image; and an updating unit configured to correct the gradation conversion table stored in the storage unit based on the measurement result of the pattern image, and to update the gradation conversion table stored in the storage unit to the corrected gradation conversion table.

2. An image forming apparatus comprising:

a converting unit configured to convert image data based on a gradation conversion condition; and an image forming unit configured to form a toner image based on the image data converted by the converting unit, the image forming unit having an exposure unit configured to irradiate light based on the image data to form an electrostatic latent image and a developing unit configured to develop the electrostatic latent image;

an acquiring unit configured to acquire a consumption amount of toner consumed by the developing unit;

a determining unit configured to determine, based on the consumption amount acquired by the acquiring unit, a replenishment amount of toner to be replenished to the developing unit;

a setting unit configured to set intensity of light to be irradiated by the exposure unit based on the consumption amount acquired by the acquiring unit and the replenishment amount determined by the determining unit;

a controller configured to control the converting unit to convert measuring image data based on the gradation conversion condition, and control the image forming unit to form a measuring image corresponding to the converted measuring image data with the intensity of light set by the setting unit;

a measuring unit configured to measure the measuring image; and an updating unit configured to update the gradation conversion condition based on a measurement result of the measuring unit.

3. The image forming apparatus according to claim 2, wherein the setting unit is configured to determine a predictive amount of electrostatic charge of toner in the developing unit based on the consumption amount acquired by the acquiring unit and the replenishment amount determined by the determining unit and set the intensity of light to be irradiated by the exposure unit in accordance with the predictive determined amount of electrostatic charge.

4. The image forming apparatus according to claim 3, wherein the developing unit is configured to contain toner and carrier, and wherein the setting unit is configured to determine the predictive amount of electrostatic charge of toner in the developing unit based on the consumption amount acquired by the acquiring unit, the replenishment amount determined by the determining unit, and a mixture ratio between the toner and the carrier in the developing unit.

5. The image forming apparatus according to claim 3, wherein the setting unit is configured to determine the predictive amount of electrostatic charge of toner in the developing unit based on the consumption amount acquired by the acquiring unit, the replenishment amount determined by the determining unit, and an environmental humidity.

6. The image forming apparatus according to claim 2, wherein the developing unit has a container unit containing toner and a toner bearing member bearing the toner in the container unit, and wherein the setting unit is configured to set the intensity of light to be irradiated by the exposure unit based on the consumption amount acquired by the acquiring unit, the replenishment amount determined by the determining unit, and driving information on the toner bearing member.

* * * * *